US005752860A

United States Patent [19]

Greaves

[11] Patent Number: 5,752,860

[45] Date of Patent: May 19, 1998

[54] REBAR CLAMP

[76] Inventor: Christopher G. Greaves, 19 Seaview Ave., Madison, Conn. 06443

[21] Appl. No.: 744,112

[22] Filed: Nov. 5, 1996

[51] Int. Cl.[6] ..... H01R 4/44

[52] U.S. Cl. ..... 439/781; 439/100

[58] Field of Search ..... 439/781, 782, 439/100

[56] References Cited

U.S. PATENT DOCUMENTS

| | | | |
|---|---|---|---|
| 1,420,790 | 6/1922 | Varney . | |
| 1,704,350 | 3/1929 | Stanton et al. | 439/781 |
| 2,679,032 | 5/1954 | Thomas, Jr. et al. . | |
| 3,026,497 | 3/1962 | Myers et al. . | |
| 3,199,062 | 8/1965 | Wantz, Jr. | 439/781 |
| 3,892,455 | 7/1975 | Sotolongo . | |
| 4,070,849 | 1/1978 | Digiacomo . | |
| 4,310,214 | 1/1982 | Carlson . | |
| 4,361,719 | 11/1982 | Hyde . | |
| 4,376,334 | 3/1983 | Miller | 439/781 |
| 4,964,813 | 10/1990 | Francois et al. | 439/781 |
| 4,985,003 | 1/1991 | Francois et al. | 439/781 |
| 5,616,036 | 4/1997 | Polidori | 439/100 |

FOREIGN PATENT DOCUMENTS

| | | | |
|---|---|---|---|
| 1025428 | 4/1953 | France | 439/781 |
| 1124120 | 2/1962 | Germany | 439/781 |
| 4425499 | 12/1965 | Japan . | |
| 2188795 | 10/1987 | United Kingdom . | |

*Primary Examiner*—Gary F. Paumen
*Attorney, Agent, or Firm*—Bachman & Lapointe, P.C.

[57] ABSTRACT

A clamp for clamping two elongate members together, wherein one elongate member has substantially radial ridges, wherein the clamp includes a first clamp element having a first clamp surface; a second clamp element having a second clamp surface; and a member for securing the first clamp element to the second clamp element in a secured position with the first and second clamp surfaces facing each other, wherein the first and second clamp surfaces in the secured position define first and second channels for clamping two substantially elongate members, and wherein at least one channel of the first and second channels has a plurality of teeth spaced longitudinally along the channel and defining gaps therebetween.

14 Claims, 3 Drawing Sheets

REBAR CLAMP

BACKGROUND OF THE INVENTION

The invention relates generally to connectors and particularly to a clamp for clamping two elongate members preferably in substantially parallel relationship, and especially for clamping a rebar or ridged rod to a conductor.

In various applications, rebar is used as a part or reinforcement to structural frame work for various structures such as, for example, in-ground swimming pools and the like. When used in swimming pools, some government regulation requires that the rebar be connected to a common bonding grid. It is also desirable to connect rebar in such applications to grounding conductors.

A number of disclosures have been made with respect to clamps for connecting various structures to ground wire or a grounding conductor. Examples of such disclosure include U.S. Pat. No. 2,679,032 to Thomas, Jr. et al. and U.S. Pat. No. 3,892,455 to Sotolongo. Such devices, although useful for general applications, have inherent disadvantages when attempted to be used for clamping rebar material, which is a reinforcing rod structure, typically made of steel or other desired material, and which has a series of generally non-continuous and substantially radial ridges positioned thereon. When used in connection with rebar, conventional clamping devices suffer from a reduced contact surface area due to the radial ridges of the rebar, thereby resulting in undesirable slippage of the clamp with respect to the rebar which can lead to a break or interruption in the desired electrical continuity between the elements.

The need remains for a clamp for clamping rebar material which provides a firm grip of or connection to the rebar material and which addresses the tendency of the conventional clamp to slip or rotate around the rebar.

It is therefore the primary object of the present invention to provide a clamp for clamping a rebar material without movement such as slipping and/or rotation so as to ensure that electrical continuity is maintained.

It is a further object of the present invention to provide a clamp for clamping rebar which is easily installed on potentially lengthy sections of rebar and grounding wire.

It is another object of the present invention to provide a clamp which readily adapts to elongate members of differing diameter.

It is a still further object of the present invention to provide a clamp which is simple and inexpensive to produce, which is easy to install with a limited number of tools, and which is reliable for long-term use in potentially hostile environments.

Other objects and advantages of the present invention will appear hereinbelow.

SUMMARY OF THE INVENTION

In accordance with the invention, the foregoing objects and advantages are readily attained.

According to the invention, a clamp is provided for clamping two elongate members together, wherein one elongate member has substantially radial ridges, the clamp comprising a first clamp element having a first clamp surface; a second clamp element having a second clamp surface; and means for securing the first clamp element to the second clamp element in a secured position with the first and second clamp surfaces facing each other, wherein the first and second clamp surfaces in the secured position define first and second channel means for clamping two substantially elongate members, and wherein at least one channel means of the first and second channel means has a plurality of teeth spaced longitudinally along the at least one channel means and defining gaps therebetween.

The clamp of the present invention is particularly useful for clamping a rebar or rod having radial ridges to a conductor.

In further accordance with the invention, a method is provided for clamping a rebar member to a conductor which method comprises the steps of providing a clamp comprising a first clamp element having a first clamp surface, a second clamp element having a second clamp surface, and means for securing the first clamp element to the second clamp element in a secured position with the first and second clamp surfaces facing each other, wherein the first and second clamp surfaces in the secured position define first and second channel means for clamping two substantially elongate members, and wherein at least one channel means of the first and second channel means has a plurality of teeth spaced longitudinally along the at least one channel means and defining gaps therebetween; positioning the first and second clamp elements on both sides of the rebar member and the conductor with the rebar member disposed in the at least one channel means having teeth and the conductor disposed in another of the first and second channel means; and securing the first clamp element to the second clamp element in the secured position with the means for securing so as to firmly clamp the rebar member and the conductor together.

BRIEF DESCRIPTION OF THE DRAWINGS

A detailed description of preferred embodiments of the present invention follows, with reference to the attached drawings wherein.

DETAILED DESCRIPTION OF PREFERRED EMBODIMENTS

The invention relates to a clamp for use in clamping an elongate rod member having substantially radial ridges such as rebar or re-rod in electrical continuity with a ground conductor such as a substantially smooth-surfaced elongate member. The clamp of the present invention is particularly suitable for clamping to rods having radial ridges or similar structure which are collectively referred to herein as rebar.

Figure 1:
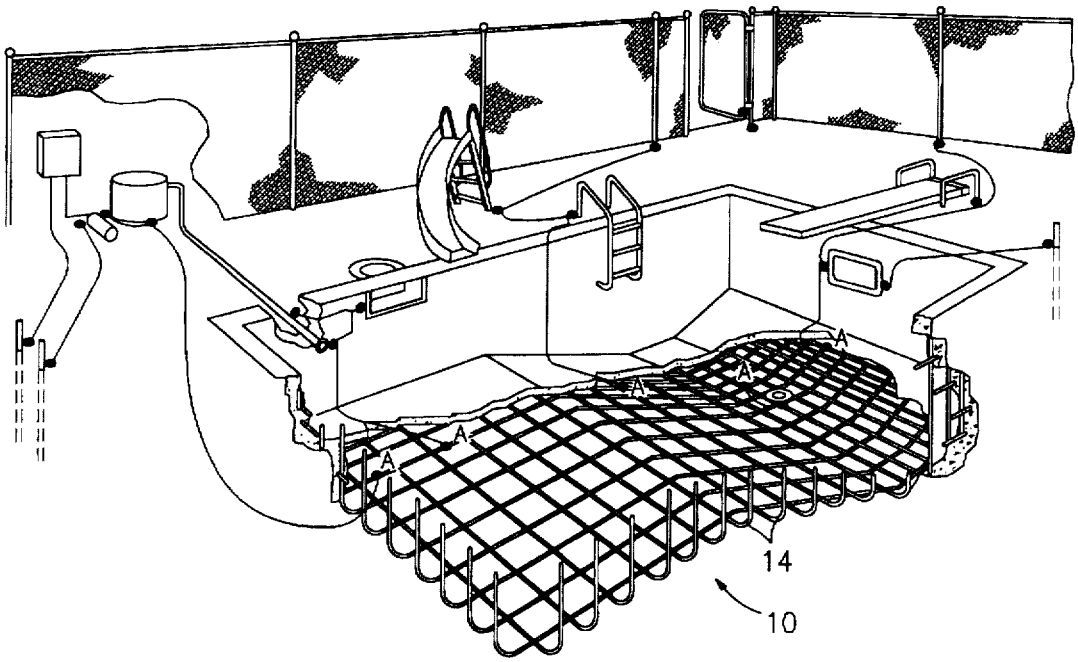
FIG. 1 is a perspective and partially cutaway view of a typical application of rebar in connection with a swimming pool construction.
Figure 1A:
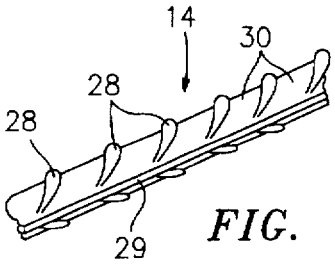
FIG. 1*a* is a perspective view of a typical rebar member.

Referring to FIG. 1, a typical use of rebar is illustrated wherein the rebar is used for structural support of an in-ground swimming pool. In the illustration of FIG. 1, the rebar material is shown in a grid-like pattern illustrated generally at reference numeral 10, which may serve as a bonding grid for dissipating static charges and the like. In connection with in-ground swimming pool applications, rebar sections or grids must be connected to a common bonding grid or grounding conductor, typically through connection to a substantially smooth surfaced conductor or the like. In FIG. 1, typical locations for connection of rebar pattern 10 to the ground conductors or other member are indicated by the letter A.

Figure 2:
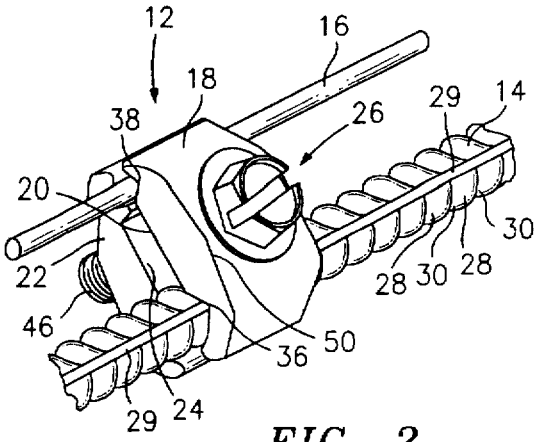
FIG. 2 is a perspective view of a clamp in accordance with the present invention clamping a rebar rod to a substantially smooth conductor ground wire in a substantially parallel relation.

Referring to FIG. 2, a clamp 12 in accordance with the present invention is shown in position clamping a rebar section 14 to a ground conductor 16. Clamp 12 according to the present invention preferably includes a first clamp element 18 having a first clamp surface 20 and a second clamp element 22 having a second clamp surface 24. In accordance with the invention, clamp surfaces 20, 24 are provided with structure so as to define channel structures or opposed jaws for grasping or clamping both rebar 14 and ground conductor 16. Clamp 12 in accordance with the invention preferably also includes structure for releasably securing first clamp element 18 and second clamp element 22 together in a clamping position around rebar 14 and ground conductor 16 as desired. In accordance with the embodiment illustrated in FIG. 2, the structure for releasably securing first clamp element 18 and second clamp element 22 together is threaded member 26.

As set forth above, and referring also to FIG. 1, rebar 14 is typically a reinforcing rod, usually made of steel, which has substantially radial ridges 28, typically continuous only for half circles along rebar 14, wherein ridges 28 define gaps or valleys 30 therebetween. Rebar 14 may also have longitudinal splines 29 as shown. Conventional smooth-mouthed or longitudinally grooved clamping devices suffer from a reduced ability to firmly grasp rebar 14 due to the reduced surface area of rebar 14 in contact with a smooth-mouthed channel or jaw which could lead to slippage and consequent interruption of the electrical continuity between clamped elements.

Figure 3:
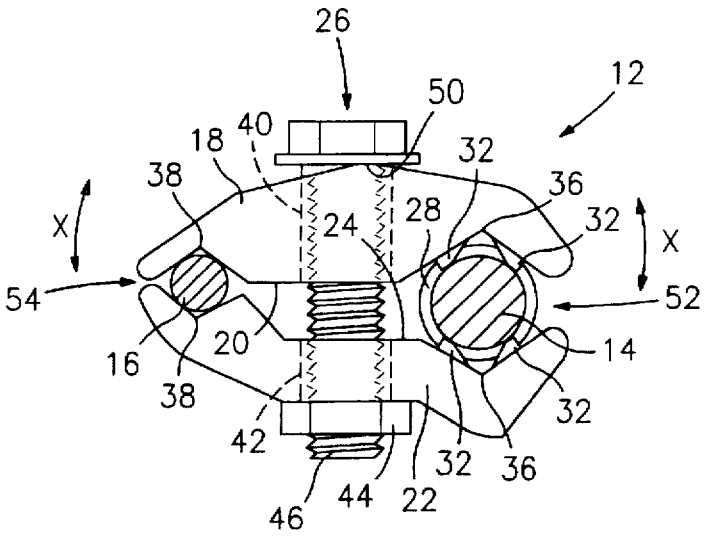
FIG. 3 is a side view of a clamp in accordance with the present invention in a secured position clamping a rebar member to a ground conductor.
Figure 4:
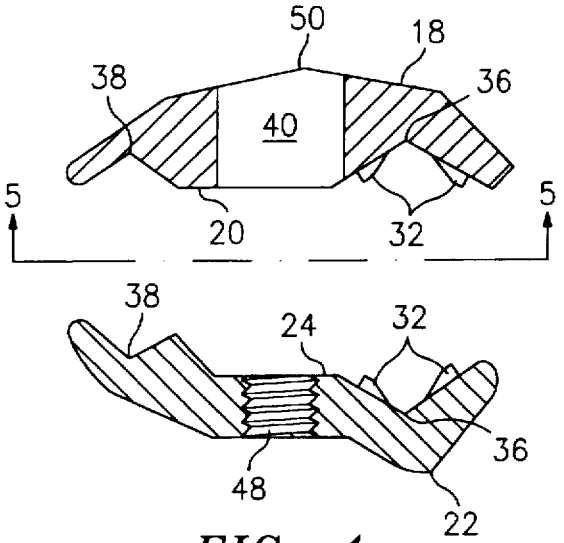
FIG. 4 is a side sectional view of clamp elements in accordance with the present invention.
Figure 5:
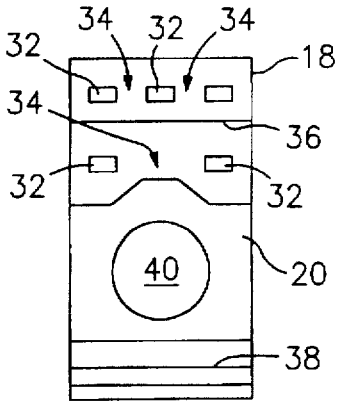
FIG. 5 is a view taken along the lines 5—5 of FIG. 4 to illustrate the clamping surface of a clamp in accordance with the present invention.

Referring to FIGS. 3–5, clamp 12 according to the invention is further described. At least one of and preferably both of first and second clamp surfaces 20, 24 of clamp elements 18, 22 are provided with a plurality of teeth which are arranged on the first and second clamp surfaces 20, 24 in a substantially discontinuous pattern, preferably discontinuous longitudinally with respect to the length of rebar 14 to be clamped. This is best illustrated in FIG. 5, wherein teeth 32 are shown defining gaps 34 therebetween. Teeth 32 spaced longitudinally as shown serve to advantageously grip in gaps 30 between ridges 28 of rebar 14 to provide enhanced clamping of same and to eliminate or greatly reduce the chance of slippage of clamp 12 relative to rebar 14. Teeth 32 are preferably substantially flat-topped projections extending from clamp surface 20, 24 preferably having a height also selected to approximate the height of ridges 28, preferably so as to firmly contact the underlying cylindrical surface of rebar 14.

As shown in FIGS. 3–5, each clamp surface 20, 24 is preferably provided with grooves 36, 38 for defining the clamp channel or mouth to receive rebar 14 and conductor 16. As shown in the drawings, grooves 36 of opposing clamp elements 18, 22 are preferably provided with teeth 32 in accordance with the invention, while grooves 38 which defining the channel for receiving conductor 16 may have substantially smooth surfaces depending upon the structure of conductor 16 to be clamped. Grooves 36, 38 may be rounded or substantially V-shaped, as desired depending upon the materials with which clamp 12 is to be used.

In accordance with the present invention, and as discussed above, teeth 32 of clamp surfaces 20, 24 advantageously serve to engage between ridges 28 of rebar 14 preferably so as to firmly contact the underlying cylindrical surface of rebar 14, so as to rapidly and effectively grasp rebar 14 and significantly reduce any possibility of slippage of clamp 12 with respect to rebar 14. Teeth 32 may preferably have a width or thickness in the longitudinal direction selected to fit within gaps 30 between ridges 28 of rebar 14.

Clamp 12 according to the invention is preferably provided of an electrically conductive material such as cast-bronze or the like so that members clamped therein are in electrical continuity or communication with each other. Preferably, each of clamp elements 18, 22 is made of a suitable material such as cast-bronze. Alternatively, select portions of one or both of clamp elements 18, 22 could be made of such material or could be provided with electrically conductive elements in accordance with the invention, so long as channels 52, 54 (See FIG. 3, described below) are in electrical continuity as desired.

Referring to FIG. 3, a side view of clamp 12 in accordance with the invention is shown in a secured position wherein clamp 12 is securely clamped to both rebar 14 and conductor 16 in a substantially parallel relationship (See also FIG. 2). First clamp element 18 is preferably provided with a bore 40 for slidably receiving threaded member 26, while second clamp element 22 is preferably provided with a bore 42 for receiving an end portion of threaded member 26. As shown in FIG. 3, threaded member 26 may be secured in place through the application of a threaded nut 44 to the threaded end 46 of threaded member 26.

Alternatively, and as shown schematically in FIG. 4, bore 42 of second clamp element 22 may suitably be threaded so as to threadedly receive end 46 of threaded member 26 in accordance with the invention, thereby avoiding the need for nut 44. In this embodiment, when clamp 12 is to be applied to rebar section 14 and conductor 16, first and second clamp elements 18, 22 are positioned as desired and threaded member 26 is inserted through bore 40 of first clamp element 18 and threadedly engaged into threaded bore 48 of second clamp element 22 so as to secure first and second clamp elements 18, 22 in the desired secured position around and clamping to rebar section 14 and conductor 16.

According to a further alternative embodiment of the invention, clamp element 22 may be provided with threaded bore 48 for receiving threaded member 26 as shown in FIG. 4, and nut 44 can additionally be secured onto threaded member 26 to provide additional resistance to loosening or slippage of clamp 12.

Bore 40 of first clamp element 18 in accordance with the invention is preferably sized to accept threaded member 26 with sufficient clearance that first clamp element 18 is allowed to pivot with respect to threaded member 26 and second clamp element 22 as illustrated by arrows X in FIG. 3. The allowed pivot of clamp 12 in accordance with the present invention advantageously allows clamp 12 to be secured to rebar section 14 and conductor 16 having different sizes or diameters, while still maintaining electrical contact between both members and clamp 12 to assure satisfactory grounding as desired in accordance with the invention.

Referring to FIGS. 2–4, first clamp element 18 may preferably be provided with an upper surface 50 having a convex outer configuration as shown in the drawings so as to further facilitate pivot of first clamp element 18 with respect to threaded member 26 as desired in accordance with the invention and as shown by arrows X in FIG. 3.

Referring back to FIG. 2, it is preferred that clamp 12 be provided having a configuration wherein installation is quick and easy and requires the fewest possible number of tools for installation. In this regard, threaded member 26 is preferably provided with a slotted and hex-shaped head so that clamp 12 can be firmly installed in a secured position with respect to rebar section 14 and conductor 16 using a simple screw driver or wrench.

Further, the provision of first and second clamp elements 18, 22 and threaded member 26 for releasably securing same advantageously allows for clamp elements 18, 22 to be positioned around elongate members to be clamped together, for example through side entry, without requiring clamp 12 to be slid along a potentially lengthy section of rebar 14 and/or conductor 16 to the desired position of clamping.

In further accordance with the invention, clamp 12 may suitably be applied to any desired rebar section 14 for electrically connecting rebar 14 to conductor 16 by positioning first and second clamp elements 18, 22 on either side of rebar section 14 and conductor 16, preferably in substantially parallel relationship as shown for example in FIG. 2. Threaded member 26 may then be positioned through first clamp element 18 and threaded into bore 48 of second clamp element 22 and/or nut 44 so as to securely grip or clamp rebar section 14 in channel or mouth structure 52 having at least some of teeth 32 engaged in gaps 30 between ridges 28 so as to prevent slippage of clamp 12 with respect to rebar 14 and so as to clamp conductor 16 in channel 54 of clamp 12 which in the illustrated embodiment does not have teeth so as to insure good electrical contact between clamp 12 and substantially smooth-surfaced conductor wire 16. Once clamp elements 18, 22 are in position with rebar section 14 and the conductor 16 in position in channels 52, 54 as desired, threaded member 26 is tightened in accordance with the invention so as to releasably but firmly hold clamp 12 in the secured position of the present invention.

It should be noted that although clamp 12 as illustrated has channels 52, 54 for substantially parallel rebar 14 and conductor 16, alternative arrangements are within the scope of the present invention wherein elements to be clamped could be in different orientation.

Figure 6:
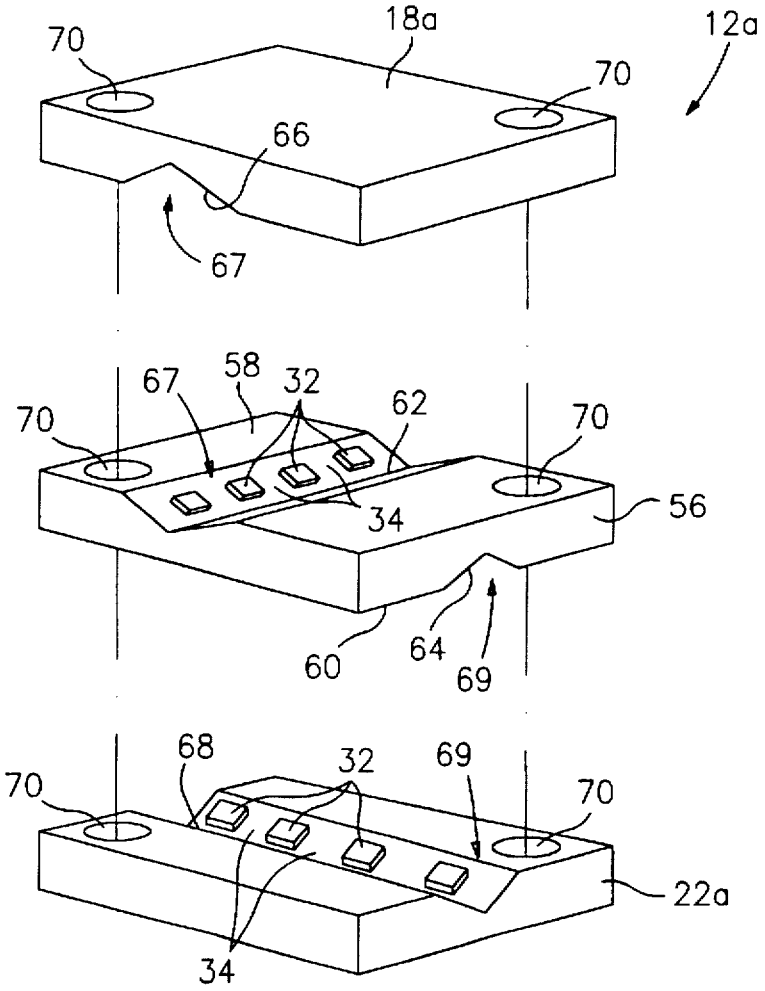
FIG. 6 is an exploded view of an alternative embodiment of the invention.
Figure 3:
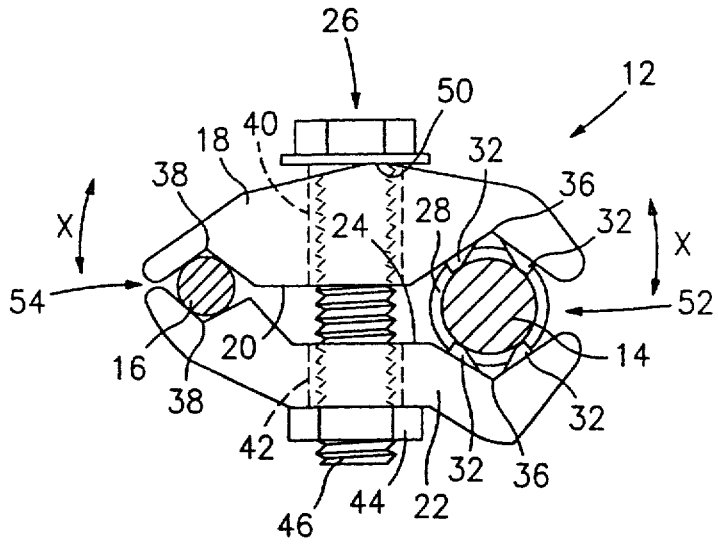
Figure 4:
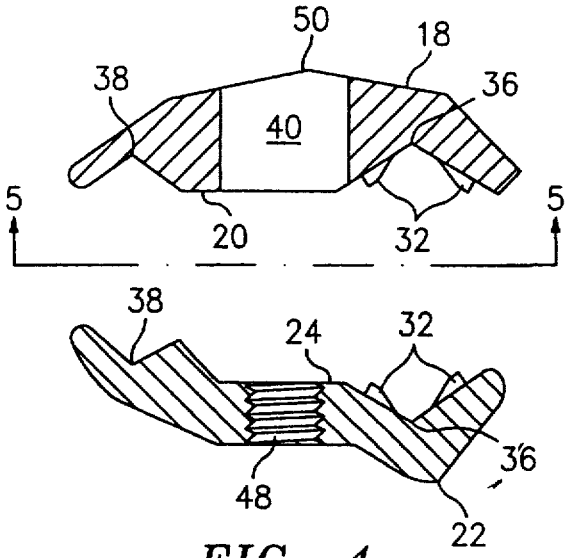
Figure 5:
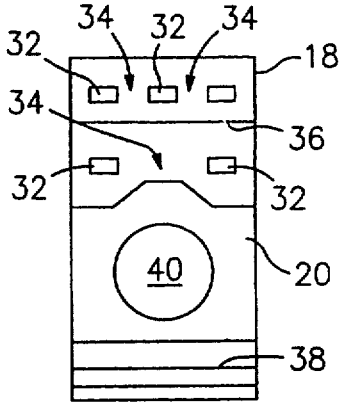

For example, FIG. 6 shows an alternative embodiment of the present invention for use in clamping elongate members in a substantially perpendicular arrangement. FIG. 6 shows clamp **12*a* having first and second clamp elements 18*a*, 22*a*, as well as an intermediate clamp element 56. According to this embodiment, intermediate element 56 has two opposed clamping surfaces 58, 60, each of which has a groove or indentation 62, 64. Elements 18*a*, 22*a* have grooves or indentations 66, 68. As shown, element 18*a* is arranged so that groove 66 mates with groove 62 of intermediate member 56 to define a first channel or jaws 67 to receive an elongate member, and element 22*a* is arranged so that groove 68 mates with groove 64 to define a second channel or jaws 69 for receiving another elongate member. According to this embodiment of the invention, intermediate clamp element 56 has grooves 62, 64** arranged at a desired angle relative to each other, in this example perpendicular, to accommodate alternative configurations.

Fasteners (not shown) are used as discussed above, preferably through holes 70 in elements **18*a*, 22*a* and 56 to secure elements 18*a*, 22*a* and 56** with elongate members grasped therebetween.

Still referring to FIG. 6, channels 67, 69 may both be provided with teeth 32 as shown so as to accommodate rebar 14 as both elongate elements to be clamped. Alternatively, the clamp configuration of clamp **12*a* could be used with teeth 32 on only one channel 67 or 69 so as to clamp rebar 14 to a smooth-surfaced conductor 16 as in previous embodiments, but at an angle. Also, the teeth configuration of FIG. 6 could be incorporated into the embodiments of FIGS. 2–5 so as to clamp two sections of rebar 14** in substantially parallel relationship.

Clamp 12 is disclosed in connection with a preferred embodiment wherein rebar 14 is to be electrically clamped to a smooth conductor 16 (FIGS. 2–5) or another section of rebar 14 (FIG. 6). It should be noted that the channel structure of clamp 12, **12*a* could readily be adapted for conductors 16** of different shape within the broad scope of the present invention.

In accordance with the foregoing, it should be readily appreciated that a clamp has been provided in accordance with the present invention for use in clamping a rebar section or other material having an irregular outside surface, especially having an outside surface provided with radial ridges or partial ridges, to a conductor in a simple and reliable manner so as to easily comply with requirements that rebar sections in various applications be bonded or grounded.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A clamp for clamping two elongate members together, wherein one elongate member has substantially radial ridges, the clamp comprising:

a first clamp element having a first clamp surface means;

a second clamp element having a second clamp surface; and means for securing the first clamp element to the second clamp element in a secured position with the first and second clamp surfaces facing each other, wherein the first and second clamp surfaces in the secured position define first and second channel means for clamping two substantially elongate members, and wherein at least one channel means of the first and second channel means has a plurality of flat-topped teeth spaced laterally and longitudinally along the at least one channel means and defining gaps therebetween.

2. A clamp according to claim 1, wherein the first and second clamp surface means each have first and second grooves which define the first and second channel means in the secured position.

3. A clamp according to claim 2, wherein the first and second clamp elements each have a plurality of said teeth spaced longitudinally along the first grooves so as to define the gaps, and wherein the second grooves are substantially smooth in a longitudinal direction.

4. A clamp according to claim 3, wherein the first and second clamp elements have intersecting opposed arms defining the first grooves and wherein a plurality of said teeth are provided on each opposed arm.

5. A clamp according to claim 1, wherein each tooth of the plurality of teeth has a width in the longitudinal direction selected to fit between substantially radial ridges of the one elongate member.

6. A clamp according to claim 1, wherein the first and second clamp elements each have an opening arranged substantially transverse to the first and second channel means, and wherein the means for securing comprises threaded means for passing through the opening of one clamp element of the first and second clamp elements and for threadedly engaging the other element of the first and second clamp elements whereby the first and second clamp elements are releasably securable in the secured position.

7. A clamp according to claim 6, wherein the threaded means further has a head portion, and wherein the opening of the one clamp element is sized to non-threadedly receive the threaded member with the one clamp element abutting the head portion whereby lateral pivot of the one clamp element relative to the other clamp element is permitted during tightening toward the secured position.

8. A clamp according to claim 7, wherein the head portion is a slotted and hex-shaped screw head.

9. A clamp according to claim 1, wherein the first and second channel means are substantially parallel.

10. A clamp according to claim 1, wherein at least a portion of at least one of the first and second clamp elements is electrically conductive so as to define electrical connection between the first and second channel means.

11. A clamp according to claim 1, wherein at least the first and second clamp surfaces are made of an electrically conductive material.

12. A clamp according to claim 1, wherein the first and second clamp elements are made of cast-bronze.

13. A clamp according to claim 1, wherein the first and second channel means are substantially perpendicular.

14. A clamp according to claim 1, wherein each channel means of the first and second channel means has a plurality of said teeth spaced longitudinally along each channel means.

* * * * *

UNITED STATES PATENT AND TRADEMARK OFFICE

CERTIFICATE OF CORRECTION

PATENT NO. : 5,752,860

DATED : May 19, 1998

INVENTOR(S) : Christopher Greaves

It is certified that error appears in the above-identified patent and that said Letters Patent is hereby corrected as shown below:

The title page, showing the illustrative figure 3, should be deleted and substituted with the attached title page.

In the drawings; delete figure 3, and substitute attached figure 3.
Column 6, claim 1, line 39, after "surface" but before the ";" insert -- means--.

Signed and Sealed this

Eighth Day of September, 1998

*Attest:*

Bruce Lehman

BRUCE LEHMAN

*Attesting Officer*

*Commissioner of Patents and Trademarks*

United States Patent [19]

Greaves

[11] Patent Number: 5,752,860

[45] Date of Patent: May 19, 1998

[54] REBAR CLAMP

[76] Inventor: Christopher G. Greaves, 19 Seaview Ave., Madison, Conn. 06443

[21] Appl. No.: 744,112

[22] Filed: Nov. 5, 1996

[51] Int. Cl.[6] ..... H01R 4/44

[52] U.S. Cl. ..... 439/781; 439/100

[58] Field of Search ..... 439/781, 782, 439/100

[56] References Cited

U.S. PATENT DOCUMENTS

| | | | |
|---|---|---|---|
| 1,420,790 | 6/1922 | Varney . | |
| 1,704,350 | 3/1929 | Stanton et al. | 439/781 |
| 2,679,032 | 5/1954 | Thomas, Jr. et al. . | |
| 3,026,497 | 3/1962 | Myers et al. . | |
| 3,199,062 | 8/1965 | Wantz, Jr. | 439/781 |
| 3,892,455 | 7/1975 | Sotolongo . | |
| 4,070,849 | 1/1978 | Digiacomo . | |
| 4,310,214 | 1/1982 | Carlson . | |
| 4,361,719 | 11/1982 | Hyde . | |
| 4,376,334 | 3/1983 | Miller | 439/781 |
| 4,964,813 | 10/1990 | Francois et al. | 439/781 |
| 4,985,003 | 1/1991 | Francois et al. | 439/781 |
| 5,616,036 | 4/1997 | Polidori | 439/100 |

FOREIGN PATENT DOCUMENTS

| | | | |
|---|---|---|---|
| 1025428 | 4/1953 | France | 439/781 |
| 1124120 | 2/1962 | Germany | 439/781 |
| 4425499 | 12/1965 | Japan . | |
| 2188795 | 10/1987 | United Kingdom . | |

*Primary Examiner*—Gary F. Paumen

*Attorney, Agent, or Firm*—Bachman & Lapointe, P.C.

[57] ABSTRACT

A clamp for clamping two elongate members together, wherein one elongate member has substantially radial ridges, wherein the clamp includes a first clamp element having a first clamp surface; a second clamp element having a second clamp surface; and a member for securing the first clamp element to the second clamp element in a secured position with the first and second clamp surfaces facing each other, wherein the first and second clamp surfaces in the secured position define first and second channels for clamping two substantially elongate members, and wherein at least one channel of the first and second channels has a plurality of teeth spaced longitudinally along the channel and defining gaps therebetween.

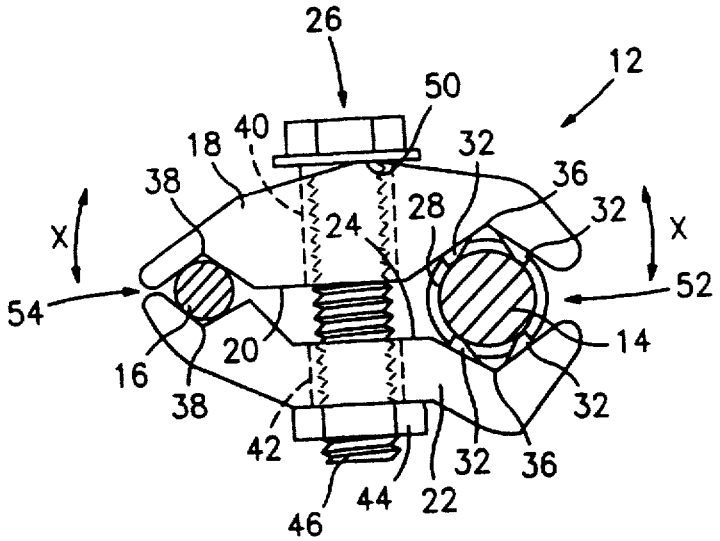

14 Claims, 3 Drawing Sheets